US011486677B2

(12) United States Patent
Bahat et al.

(10) Patent No.: US 11,486,677 B2
(45) Date of Patent: Nov. 1, 2022

(54) GRENADE LAUNCHER AIMING CONTROL SYSTEM

(71) Applicant: ISRAEL WEAPON INDUSTRIES (I.W.I.) LTD., Ramat HaSharon (IL)

(72) Inventors: Naveh Bahat, Ness Ziona (IL); Zeev Shneorson, Ra'anana (IL); Elad Davidson, Kfar Yehoshua (IL)

(73) Assignee: ISRAEL WEAPON INDUSTRIES (I.W.I) LTD., Ramat Hasharon (IL)

( * ) Notice: Subject to any disclaimer, the term of this patent is extended or adjusted under 35 U.S.C. 154(b) by 0 days.

(21) Appl. No.: 17/241,108

(22) Filed: Apr. 27, 2021

(65) Prior Publication Data

US 2022/0214140 A1 Jul. 7, 2022

(30) Foreign Application Priority Data

Jan. 7, 2021 (IL) ..... 280020

(51) Int. Cl.
*F41G 3/06* (2006.01)
*F41G 3/16* (2006.01)
*F41C 27/06* (2006.01)

(52) U.S. Cl.
CPC ..... *F41G 3/06* (2013.01); *F41G 3/16* (2013.01); *F41C 27/06* (2013.01)

(58) Field of Classification Search
CPC ..... F41G 3/06; F41G 3/16; F41C 27/06
USPC ..... 235/105, 412
See application file for complete search history.

(56) References Cited

U.S. PATENT DOCUMENTS

| | | | | |
|---|---|---|---|---|
| 6,568,118 | B1 | 5/2003 | Teetzel | |
| 6,873,406 | B1 | 3/2005 | Hines et al. | |
| 7,021,188 | B1 | 4/2006 | Berkovich et al. | |
| 7,810,273 | B2 | 10/2010 | Koch et al. | |
| 8,757,487 | B2 | 6/2014 | Santini et al. | |
| 9,127,909 | B2 | 9/2015 | Ehrlich | |
| 9,310,163 | B2 | 4/2016 | Bay | |
| 9,557,140 | B2 | 1/2017 | Gunnarsson et al. | |
| 9,574,849 | B2 | 2/2017 | Hakanson et al. | |
| 9,857,143 | B2 | 1/2018 | Teetzel et al. | |
| 10,097,764 | B2 | 10/2018 | Ehrlich | |
| 10,415,933 | B1 | 9/2019 | Kleck et al. | |
| 10,866,065 | B2 | 12/2020 | Baumgartner | |
| 2006/0005447 | A1 | 1/2006 | Lenner et al. | |
| 2011/0311949 | A1* | 12/2011 | Preston | F41G 3/26 434/16 |
| 2012/0097741 | A1 | 4/2012 | Karcher | |

(Continued)

FOREIGN PATENT DOCUMENTS

| | | | |
|---|---|---|---|
| CA | 2605585 | A1 | 11/2006 |
| DE | 102012213747 | A1 | 2/2014 |

(Continued)

*Primary Examiner* — Toan C Ly
(74) *Attorney, Agent, or Firm* — Soroker Agmon Nordman

(57) ABSTRACT

A grenade launcher, including: a barrel for launching a projectile at a real target and a sight coupled to the barrel, the sight including: a display that displays an aiming indicator and is configured to display a representative target representing the real target: a sensor configured to track motion of the barrel and accordingly the representative target is moved on the display; and wherein when the display of the representative target coincides with the aiming indicator, the launcher is aimed to launch the projectile to hit the real target.

20 Claims, 8 Drawing Sheets

(56) References Cited

U.S. PATENT DOCUMENTS

| | | | |
|---|---|---|---|
| 2017/0067719 | A1 | 3/2017 | Piepmeyer |
| 2018/0094902 | A1 | 4/2018 | Mcneil |
| 2018/0172404 | A1 | 6/2018 | Kleck et al. |

FOREIGN PATENT DOCUMENTS

| | | | |
|---|---|---|---|
| EP | 1304539 | A1 | 8/2005 |
| EP | 1762811 | A1 | 3/2007 |
| EP | 3071921 | B1 | 7/2019 |
| WO | 2006091240 | A2 | 8/2006 |
| WO | 20070030098 | A1 | 3/2007 |

* cited by examiner

GRENADE LAUNCHER AIMING CONTROL SYSTEM

FIELD OF THE DISCLOSURE

The present disclosure relates to a system for controlling launch of projectiles with a grenade launcher and more specifically to controlling aim and release of the projectile to improve accuracy in hitting targets, even targets without a direct line of sight.

BACKGROUND OF THE DISCLOSURE

Typically, grenade launchers use 40 mm low-velocity projectiles, which in contrast to smaller caliber projectiles, may have a high arc ballistic solution at times, requiring the user to aim the launcher at a high angle to achieve the maximum effective range. Likewise, due to their low velocity, the grenade launcher projectile trajectory is greatly influenced by environmental factors, such as gravity, wind, air drag, spin, launcher roll, weather and other ballistics issues. Therefore, unless the distance to the target is fairly short, the user cannot simply aim directly at a target and expect the projectile to follow the line of sight and hit the target.

Typically, to fire at a target at the distance of about 350 meters the user needs to raise the barrel of the launcher at an angle of some 40 degrees, which makes it complicated to support the launcher with the user's body and have a clear line of sight to the target, especially since the user needs to see over the barrel when aiming. As a result, common sights for grenade launchers are on the side of the firearm, or on top of the firearm but require raising a metal extension.

Typical grenade launchers use simple ballistic sights with a plurality of ballistic angle positions, usually from 50 meters every 25 meters up to 400 meters. Typically, the user selects the position based on an estimated or known distance to the target. Alternatively, the sight may be divided by different ranges, for example short range—up to about 150 meters, medium range up to about 350 meters and long range—greater than 350 meters. The longer the range, the higher the angle the firearm has to be raised by the user and when shooting to the effective distance pressing the mechanical trigger tends to shake the launcher and cause a large deviation between the hit point of the projectile and the target.

A more advanced sight for grenade launchers, e.g. "Meprolight GLS" is a sight that shows a line of sight red dot to one eye (through the barrel after manually adjusting the sight mechanically to get the right ballistic trajectory) and the target is seen by the other eye (at the side of the grenade launcher). It is left for the user's brain to combine the red dot and the target to a united view based on the view from both eyes.

The available sights are less ergonomic, complicated for use and result in poor hit-ratio. As a result, hitting targets consistently at varying ranges with a grenade launcher requires a significant amount of training.

Commonly, the grenade launcher is coupled to a standard firearm, such as the Israeli Weapons Industries' (IWI) X95 or similar rifles, under the barrel and also has a stand-alone version (IWI GL 40). Typically, the under-barrel grenade launcher (UBGL) is positioned in front of the magazine. This position makes it hard to access the mechanical trigger located on the proximal end of the grenade launcher. Various solutions to this problem include a mechanical system to circumvent the magazine well and provide a trigger closer to the user or placing the trigger on a side of the launcher in the area of the handguard. However, a trigger placed on the side of the launcher is problematic since a sideway push of the user may cause deviation in the resulting trajectory of the projectile and lead to missing the target.

Another problem with grenade launchers is estimating the distance to the target and translating the estimated distance to an elevation angle for the specific projectile being launched. Typically, the distance is estimated by the user relative to objects in the landscape or by using a Laser Range Finder (LRF). After estimating the distance the user sets a distance dial on the sight to select the elevation angle. Typically, the dial may also compensate for drift due to the trajectory followed to the target.

Grenade launchers that are coupled to a firearm typically use a single barrel that is loaded to launch a single projectile. Loading a projectile in the barrel cocks the firing pin and places the launcher in a state ready for launching the projectile. Some launchers include a safety lever to prevent accidental launch of the projectile. Some launchers have a double action trigger to enhance safety. However, such arrangements makes it harder to release the projectile without disturbing the aim to the target resulting in poor hit-ratio.

SUMMARY OF THE DISCLOSURE

An aspect of an embodiment of the disclosure, relates to a system and method for launching a projectile with a grenade launcher toward a target. The system includes a sight through which a user views a representative target that is positioned to enable the user to hit the real target by aiming the sight toward the representative target. The system may be independent in identifying the target and forming a representative target in the sight. Alternatively, the system may, be assisted with devices that are external to the sight to identify the target and help to form the representative target for the user to aim the sight.

There is thus provided according to an embodiment of the disclosure, a grenade launcher, comprising:

A barrel for launching a projectile at a real target:

A sight coupled to the barrel, comprising:

A display that displays an aiming indicator to the barrel and the display is configured to display a representative target representing the real target;

A sensor configured to track motion of the barrel and accordingly the representative target is moved on the display; and Wherein the grenade launcher is configured so that when the display of the representative target coincides with the aiming point, the grenade launcher is aimed to launch the projectile to hit the real target.

In an embodiment of the disclosure, the representative target is displayed on the display responsive to calculating a trajectory to hit the target alter first aiming the sight toward the real target. Alternatively, the representative target is displayed on the display responsive to information provided by a drone or a spotter that identified the real target. In an embodiment of the disclosure, the representative target is displayed on the display by aiming the sight at a drone that identified the real target and positioned itself to serve as the representative target. Optionally, position of the representative target is calculated by a fire control system attached to the grenade launcher or in the sight. In an embodiment of the disclosure, the calculation considers motion of the target and moves the representative target on the display accordingly. Alternatively, position of the representative target is calculated by an external device and communicated to the sight.

In an embodiment of the disclosure, the position of the representative target is updated in real time responsive to motion of the target and the grenade launcher. Optionally, the grenade launcher includes an electrical or mechanical trigger to launch the projectile using an electronic fire control system.

In an embodiment of the disclosure, the grenade launcher automatically launches the projectile when the display of the representative target coincides with the aiming point. Optionally, the representative target is represented by an image of the real target. In an embodiment of the disclosure, the representative target is positioned to take into consideration motion of the real target.

There is further provided according to an embodiment of the disclosure, a method of aiming a grenade launcher at a real target, comprising:

determining distance to the real target;

calculating a trajectory to hit the real target;

displaying a representative target representing the real target by a display of a sight coupled to a barrel of the grenade launcher; wherein the display also displays an indication of a point parallel to the barrel;

tracking motion of the barrel by a sensor in the sight or in the grenade launcher and moving the representative target accordingly on the display;

wherein the grenade launcher is configured so that when the display of the representative target coincides with the aiming point to the barrel the grenade launcher is aimed to launch the projectile to hit the real target.

In some embodiments of the disclosure, the representative target is displayed on the display responsive to calculating a trajectory to hit the target after aiming the sight toward the real target. Alternatively, the representative target is displayed on the display responsive to information provided by a drone or a spotter that identified the real target. In an embodiment of the disclosure, the representative target is displayed on the display by aiming the sight at a drone that identifies the real target and positioned itself to serve as the representative target. Optionally, the position of the representative target is calculated by a fire control system in the sight. Alternatively, position of the representative target is calculated by an external device and communicated to the sight.

There is further provided according to an embodiment of the disclosure, a method of aiming a grenade launcher at a real target, comprising:

determining distance to the real target:

calculating a trajectory to hit the real target;

displaying a representative target representing the real target through a weapon sight that is coupled to a barrel of the grenade launcher;

when the barrel is aimed toward the representative target, the grenade launcher is aimed to launch a projectile to hit the real target.

There is further provided according to an embodiment of the disclosure, a drone, comprising a controller that calculates a trajectory of a projectile from a grenade launcher position to hit a real target;

wherein the controller is configured to position the drone above the trajectory to serve as a representative target, so that when the grenade launcher is aimed at the representative target drone and the controller or the use of the grenade launcher fires the projectile, the projectile will hit the real target.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1:
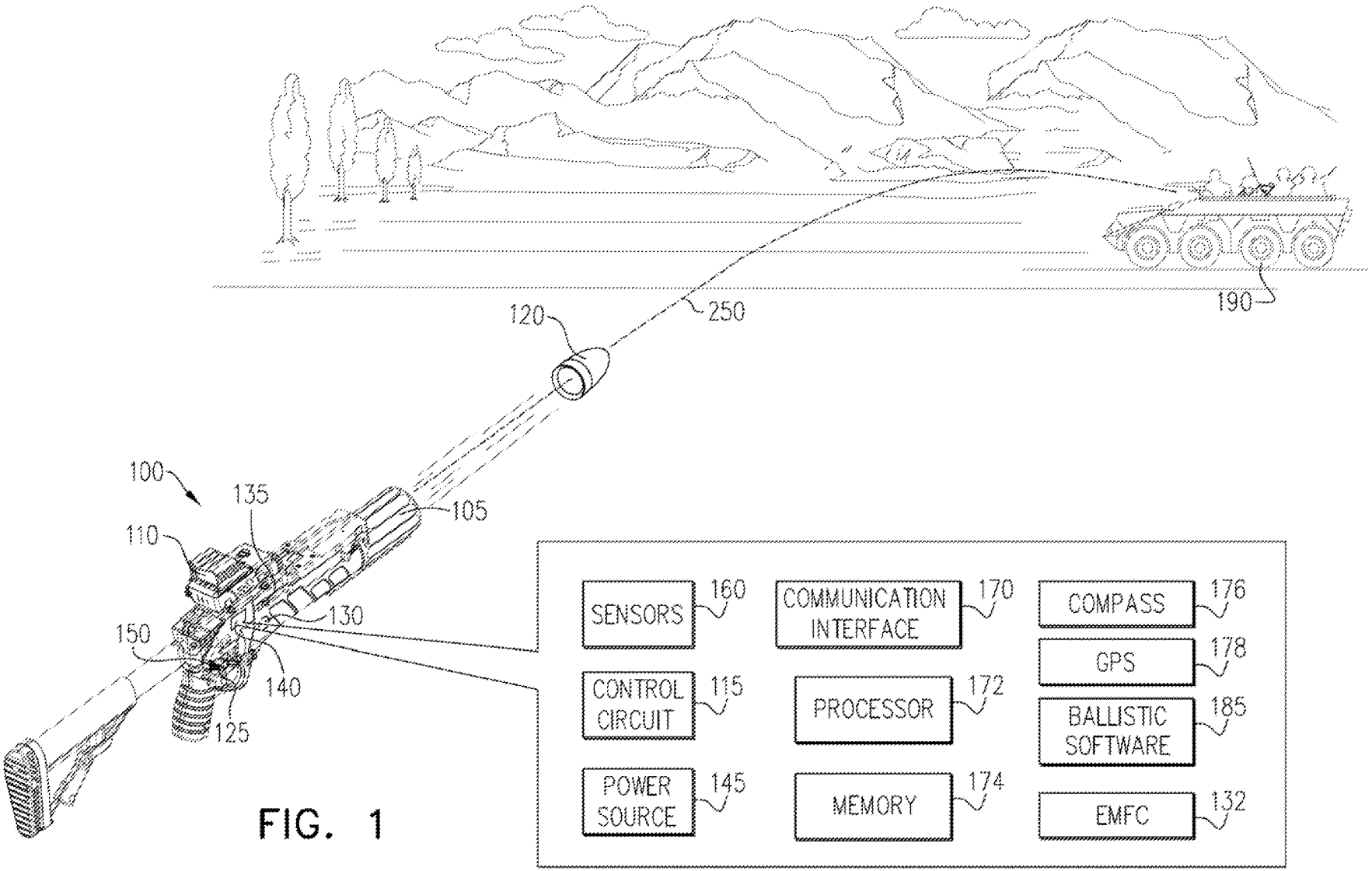
FIG. 1 is a schematic illustration of a grenade launcher with a sight. according to an embodiment of the disclosure.

FIG. 1 is a schematic illustration of a grenade launcher 100 with a barrel 105 for firing a projectile 120 and a sight 110 coupled directly or indirectly to the barrel 105, so that they move together. The grenade launcher 100 may be any under-barrel grenade launcher (UBGL) or independent grenade launcher that is transportable by a user or group of users. Optionally, the grenade launcher may have a diameter of about 78 mm, 40 mm, 38 mm or other size to support launching common projectiles. In some embodiments, the projectile can be a 40 mm grenade, such as NATO 40×46 mm low velocity grenade projectile or MK285 40×53 mm electronic programmable pre-fragmented high explosive grenade projectile, and the like. The grenade launcher 100 may be a stand-alone firearm such as GL 40 or an attachment to an existing firing solution, such as X95 IWI GL 40, which could be a handheld firearm, or a firearm installed on a vehicle or mounted on a tripod. The term "projectile" is interchangeable with the term "round" or "bullet" or "firearm ammunition", The term "launch" is interchangeable with the term "firing". In some embodiments of the disclosure, the sight 110 is configured to show a representative target 230 (FIGS. 3C, 5B, 7B) that enables aiming the grenade launcher 100 according to the representative target 230 in order to hit a real target 190, and not by aiming directly at the real target 190. The terms "target" and "real target" are interchangeable.

Optionally, the sight 110 calculates a position for displaying the representative target 230 on the display 180 so that the representative target 230 will provide the user with an indication how to aim the grenade launcher 100 to hit the target 190. The representative target 230 is provided to guide the user since the grenade launcher 100 fires a high arc trajectory so as to hit the real target 190.

Figure 2A:
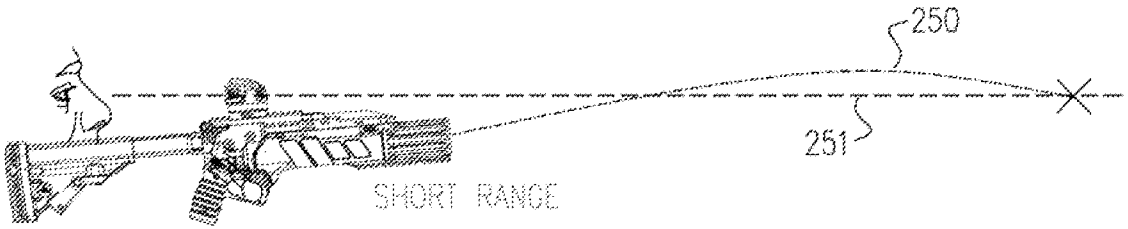
FIG. 2A is a schematic illustration of a grenade launcher launching a projectile at a short-range target.
Figure 2B:
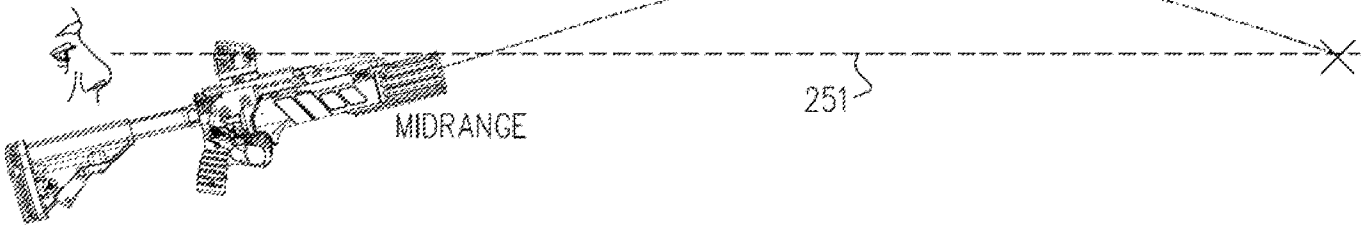
FIG. 2B is a schematic illustration of a grenade launcher launching a projectile at a medium range target.
Figure 2C:
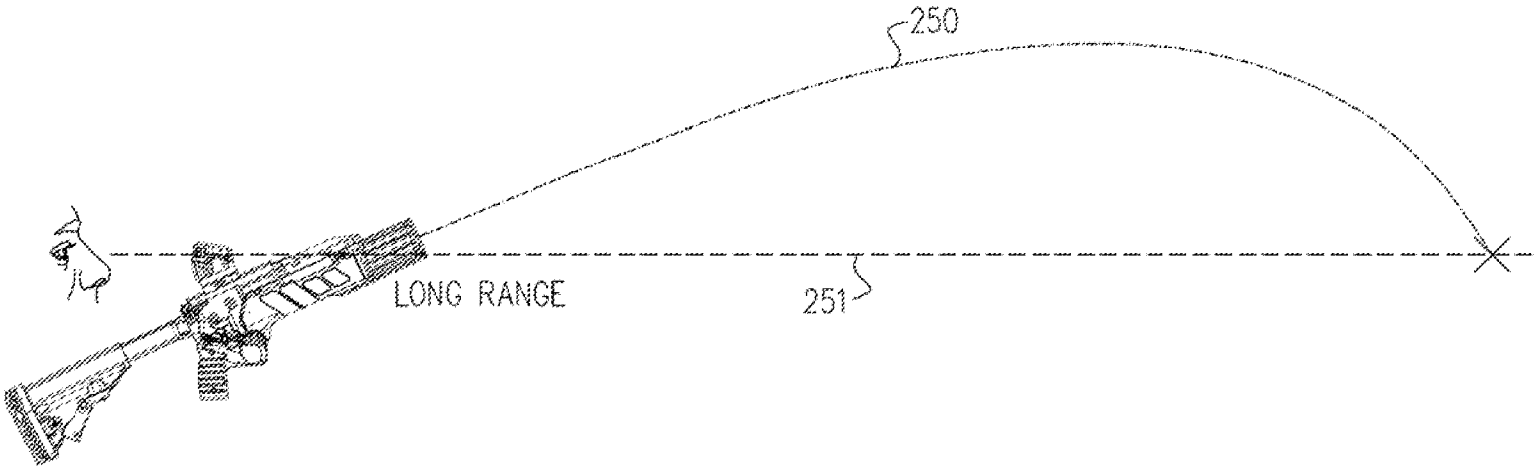
FIG. 2C is a schematic illustration of a grenade launcher launching a projectile at a long-range target.

FIGS. 2A, 2B and 2C are schematic illustrations of a grenade launcher 100 firing a projectile at a short-range target, a medium range target and a long-range target, respectively. Typically, when shooting at the real target 190 at a short distance, the real target 190 appears in the sight 110 due to a small elevation solution being required for hitting the real target 190. Therefore, the user can see the real target 190 in a direct line of sight (251 of FIG. 2A) while the projectile's trajectory is slightly lobbed (250 of FIG. 2A). However, in other cases the real target 190 would not be visible in the sight 110, or just barely visible, since the grenade launcher 100 is elevated by a large angle to a correct ballistic solution to hit target 190, or there is an obstacle that prevents the user from seeing the real target 190 such that the lobbed trajectory (250 of FIGS. 2B, 2C) would allow to hit the real target 190. In such cases the user would not have a line of sight (251 of FIG. 2C) directly to the real target 190 or may only see a fraction of the target through the available line of sight (251 of FIG. 2B).

In an embodiment of the disclosure, the grenade launcher 100 includes a fire control system (FCS) 140 including a control circuit 115 that is configured to electronically activate launching of the projectile 120 with an electro-mechanical firing control (EMFC) 132 instead of using the mechanical trigger 125. Optionally, the mechanical trigger may slightly shift the direction of the barrel 105 of the grenade launcher 100 when physically squeezing the trigger 125 after aiming the barrel 105 toward the target 190. In an embodiment of the disclosure, engaging the mechanical trigger 125 may he a safety demand but the projectile 120 will be fired only after receiving a FCS 140 command to fire. The FCS 140 may he located within the sight 110, in the grenade launcher 100 or certain elements may be located in the sight 110 and certain elements may be located in the grenade launcher 100. Optionally, the FCS 140 includes a processor 172, a memory 174, a compass 176, a GPS 178, ballistic software 185 and sensors 160 such as an accelerometer, a gyro, a temperature sensor, a Laser Range Finder (LRF), a light sensor, a wind sensor and any other sensor that may be used to process location information of the grenade launcher 100, the target 190 and calculate a required trajectory 250 (FIG. 3A) for the projectile 120 to be fired from the grenade launcher 100 and hit the target 190. Optionally, a mechanical trigger is used to fire the grenade launcher 100 projectile 120.

In an embodiment of the disclosure, a mechanical cocking mechanism 130 or the EMFC 132 is cocked by loading the projectile 120 into barrel 105. Optionally, the grenade launcher includes a safety lever 135, which is used to prevent accidentally firing the projectile 120. In an embodiment of the disclosure, the mechanical trigger 125 is provided as a backup in case of failure of the EMFC 132 or the control circuit 115, for example, due to depletion of power from a power source 145. The power source 145 may be a rechargeable battery or non-rechargeable battery or other power source, for example, a solar rechargeable power source.

In some embodiments of the disclosure, the mechanical trigger 125 serves as another safety measure and the user will have to engage it to enable the EMFC 132 to electrically fire the grenade launcher 100.

In some embodiments of the disclosure, the FCS 140 includes an activation switch 150, for example a push to talk (PTT) button, which when pressed causes the control circuit 115 to firing the projectile 120, without the torque caused by use of the mechanical trigger 125. Alternatively, the control circuit 115 provides the instructions to fire the projectile 120 automatically responsive to a signal from the FCS 140 or the sight 110 in response to correctly aiming the barrel 105 as explained below. Further alternatively, the control circuit 115 may provide the instruction to fire the projectile 120 in response to instructions received from an external source via a communication interface 170. For example, using a remote control (not shown) that activates the grenade launcher 100, when the user notifies that barrel 105 is correctly aimed toward the target 190. Optionally, control circuit 115 is connected through processor 172 to activation switch 150 or mechanical trigger 1125 and provides the instructions to fire the projectile loaded into the grenade launcher 100.

In an embodiment of the disclosure, control circuit 115 uses the electro-mechanical firing control (EMFC) system 132 such as described in U.S. Pat. No. 10,845,148 filed on Jan. 20, 2019 the disclosure of which is incorporated herein by reference, to activate firing a projectile 120 in response to an electronic signal such as provided by pushing activation switch 150 or by control circuit 115 when correctly aiming the sight 110.

Figure 3A:
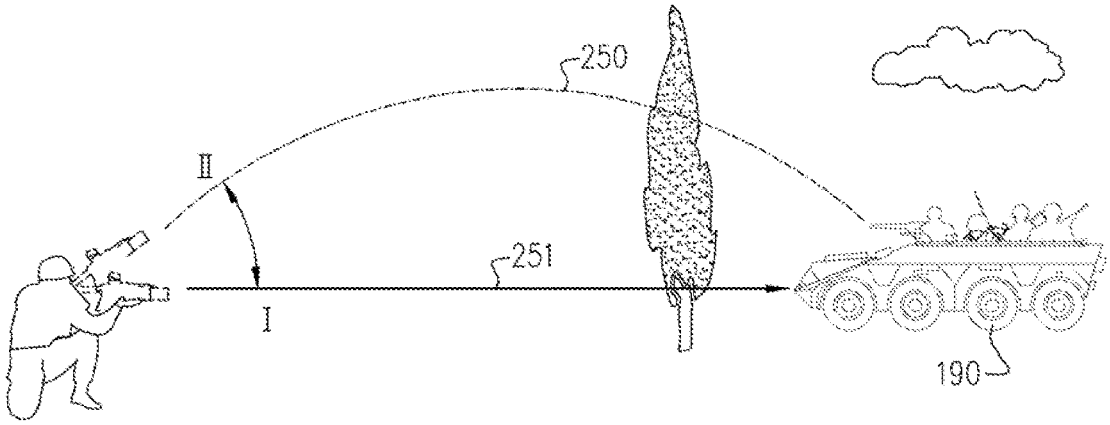
FIG. 3A is a schematic illustration of a grenade launcher, selecting a target, according to an embodiment of the disclosure.
Figure 3B:
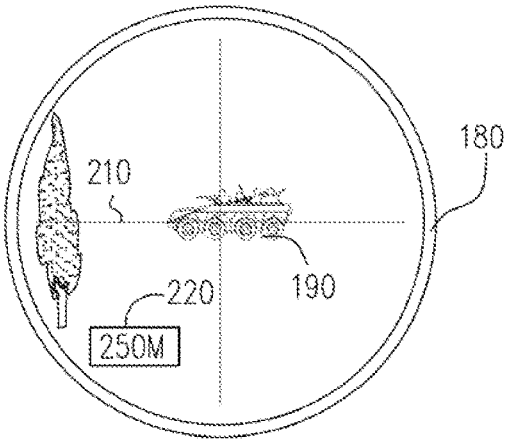
FIG. 3B is a schematic illustration of a display of sight of grenade launcher in a first state (I) while identifying and selecting a target, according to an embodiment of the disclosure.
Figure 3C:
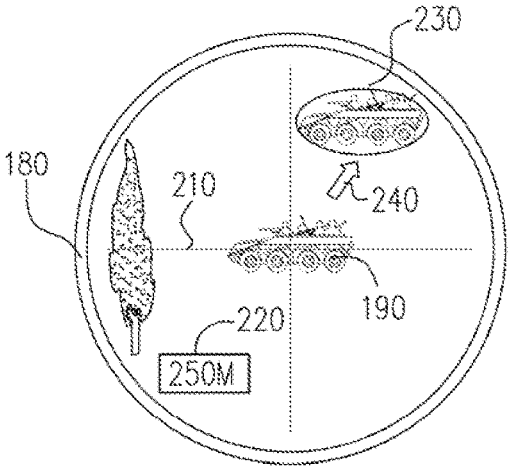
FIG. 3C is a schematic illustration of a display of a sight of a grenade launcher in a first state (I) after selecting a target and calculating a representative target position on the display, according to an embodiment of the disclosure.
Figure 3D:
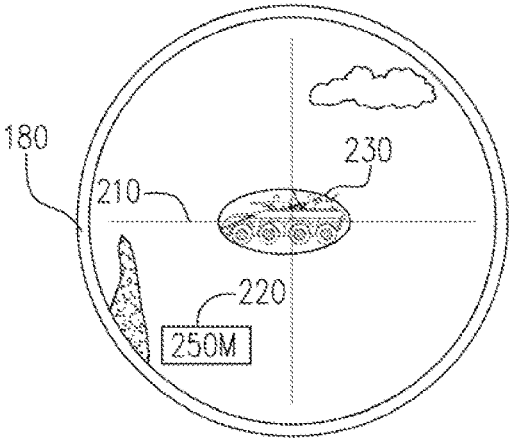
FIG. 3D is a schematic illustration of a display of a sight of a grenade launcher after aiming the grenade launcher at a representative target, according to an embodiment of the disclosure.
Figure 4:
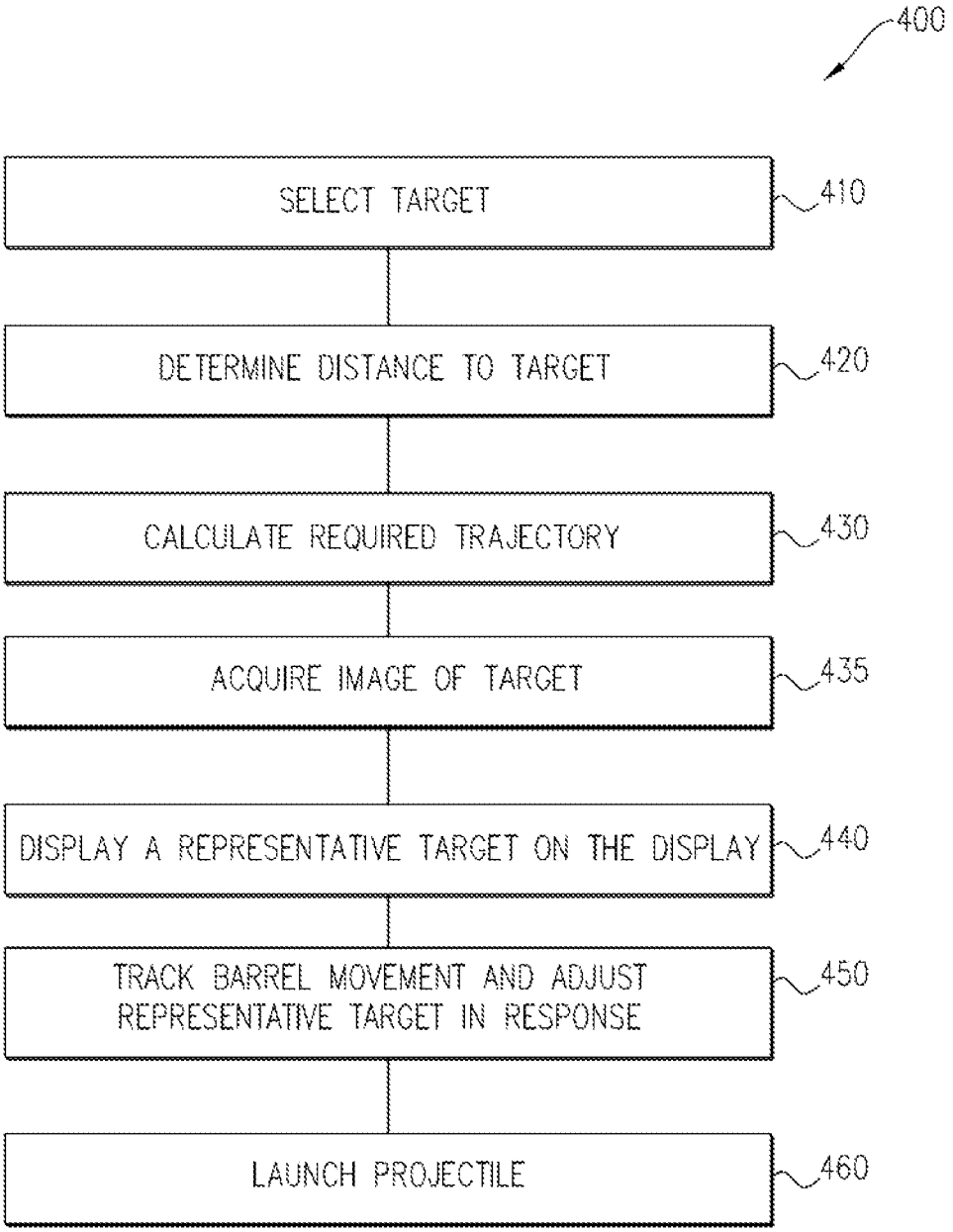
FIG. 4 is a flow diagram of a method of indirectly aiming a grenade launcher at a representative target, according to an embodiment of the disclosure.

FIG. 3A is a schematic illustration of the grenade launcher 100, tiring projectile 120 at target 190 in a first state (I) and a second state (II), according to an embodiment of the disclosure. FIG. 3B is a schematic illustration of a display 180 of sight 110 of grenade launcher 100 in the first state (I) while selecting the real target 190, according to an embodiment of the disclosure. FIG. 3C is a schematic illustration of a display 180 of sight 110 of grenade launcher 100 in the first state (I) after selecting the real target 190 and showing representative target 230 on display 180 after calculating a ballistic solution, according to an embodiment of the disclosure. FIG. 3D is a schematic illustration of display 180 of sight 110 of grenade launcher 100 in the second state (II) after the user aims the grenade launcher at the representative target 230, according to an embodiment of the disclosure. In FIG. 3D, the user of the grenade launcher cannot see the real target 190 in the sight display 180 field of view since the grenade launcher is aimed such that the real target 190 is outside the sight display 180 field of view. FIG. 4 is a flow diagram of a method (400) of launching a projectile using a grenade launcher, such as through indirectly aiming the grenade launcher 100 at real target 190, according to an embodiment of the disclosure.

Initially (in the first state (I)) the user selects (410) the target by aiming the sight 110 coupled to the barrel 105 of the grenade launcher 100 toward the target 190 and places an aiming indicator, which is a unique symbol visible to the user, on the target 190. The aiming indicator is ballistically calibrated to the grenade launcher, e.g. placing a red dot or a crosshair 210 of sight 110 on the target 190 when the grenade launcher is aimed at the target. The terms "aiming indicator" and "aiming point" are interchangeable.

Optionally, the user presses a button or activates some other indication signal such that the position of a real target 190 relative to the grenade launcher 100 is selected (e.g., into fire control system (FCS) 140 of sight 110 or the grenade launcher 100). Optionally, FCS 140 uses sensors like a gyroscope, accelerometer, compass (magnetometer). GPS, and/or other sensors to record the real target position, when the target is in a line of sight 251 of the user. If the target is in motion the sensors may also measure the targets velocity. In some embodiments of the disclosure, FCS 140 automatically identifies and selects the real target 190 through an algorithm for target recognition. Optionally, sight 110 determines (420), using sensors 160, or a range finder (not shown), the location and distance to the target and calculates (430) a required trajectory 250 to hit the target, for example using FCS 140. Optionally, the trajectory 250 is calculated by processor 172 based on the location of the real target 190 relative to the grenade launcher 100.

In an embodiment of the disclosure, once the real target 190 is selected, the sight 110 acquires (435) an image, e.g., a still image or a video frame image to serve as the representative target 230 of the target. Alternatively a graphic icon may be used as the representative target 230. The graphic icon may be any indication of a representative target, including a shape other than the aiming indicator, a flashing shape, a shape such as the aiming indicator having a different color, and the like. In sonic embodiments of the disclosure, the representative target 230 replaces the display of the real target 190 on the display 180. Alternatively, the display 180 may continue to show the real target 190 in addition to the representative target 230 as long as the real target is within the field of view of the sight 110 (see FIG. 3C).

In an embodiment of the disclosure, once the real target 190 is selected, the processor 172 or the sight 110 using sensor 160 and/or other coupled range finder and/or sensor identify the location of the real target 190 relative to the grenade launcher 100 and using ballistic software 185 (which may be part of the grenade launcher 100 or part of the sight 110) calculate a ballistic solution to hit the real target given the specific weapon and platform used. The ballistic solution is referred to herein as trajectory and optionally, may include lateral and side required traverse or movement required to be performed by the user of the grenade launcher 100, given various environmental and weapon and platform information and data available.

In an embodiment of the disclosure, the representative target 230 is displayed (440) on the display 180 after placing the aiming indicator of sight 110 on the target 190 and selecting the real target 190 (e.g., by pressing a activation switch 150 or trigger 125). Alternatively, the representative target 230 may be displayed (440) on the display 180 or its position on the display 180 may be updated after determining (420) the distance and/or after calculating (430) the required trajectory 250. Optionally, the representative target shown is a real image of the target 190 which may have an additional feature distinguishing it from the real target 190, e.g. a circle or a box around it as shown in FIGS. 3C, 3D.

Once placed on the display 180, the representative target 230 provides an indication of the direction for aiming barrel 105 toward real target 190. Optionally, the representative target 230 may he placed on the circumference of the display 180 to indicate that a large amount of adjusting is required to aim the barrel 105 correctly to hit the real target 190. Alternatively or additionally, an arrow 240 or other such indication may be placed on the display 180 pointing in the required direction for aiming the barrel 105 so as to hit real target 190. Optionally, if only a small amount of adjusting is required the representative target 230 may be placed closer to the center oft he display 180 (e.g. near the crosshair). Optionally, if only a small amount of adjusting is required the representative target 230 may be placed closer to the center of the display 180 replacing the real target 190 (e.g. hiding the real target 190 and providing an indication showing the representative target 230 is not the real target 190).

As explained above after selecting. (410) the target by placing the aiming indicator, e.g. crosshair 210 of sight 110 on the real target 190, a distance to the real target 190 is determined (420), in order to calculate (430) the required trajectory 250 of the projectile 120 to hit the real target 190. The distance may be determined (420) by the following methods:

1. Manually entered by the user, for example with a dial or keypad based on an estimate, a map or prior knowledge;
2. Automatically or manually by measuring the distance with a distance measuring device (e.g. with a Laser Range Finder (LRF));
3. Automatically by the sight 110 analyzing the acquired image of the target 190 and calculating the distance by known methods, e.g., image processing methods.

Optionally, the determined distance to the target 190 may be displayed in a sight window 220 on the display 180, for example as shown in FIG. 3C and FIG. 3D.

Optionally, a location of the real target 190 relative to the grenade launcher 100, may include not just the distance but also the azimuth to the real target 190. Optionally, the actual location of the real target is spatially calculated. In an embodiment of the disclosure, the sight 110 or FCS 140 include sensors 160, which are configured to track motion of the barrel 105 or of the sight 110, which is coupled to the barrel 105. Optionally, the sensors 160 may include a mieroelectromechanical system mems) gyroscope, accelerometer, magnetometer or other type of sensor. The sensors 160 track (450) movement of the barrel 105 or sight 110 and the representative target 230 is moved on the display 1180 responsive to the motion of the barrel 105. The user moves the barrel 105 while following the motion of the representative target 230 on display 180. In an embodiment of the disclosure, the user holds down the activation switch 150 to indicate that the real target 190 is moving. Optionally, the relative location of the real target 190 would be continuously recalculated while the user is holding down activation switch 150 such that the representative target 230 is moved on the display to allow the projectile 120 to hit the real target 190 even though it is in motion. In such embodiment, the real target 190 is no longer shown when it is outside the field of view of the sight 110 but the FCS 140 continues to move the representative target. based on the movement made by the user while the activation switch 150 was pressed down. Optionally, when the activation switch 150 is released, the FCS 140 interprets the release as an indication that the real target 190 is no longer moving. Optionally, the error window is adjusted to account for the movement of the target. Optionally, the representative target 230 is displayed with a correction taking into consideration the movement of the real target 190 and the time for the projectile to reach the real target 190. In such an embodiment, the representative target may be shifted accordingly such that when the aiming indicator coincides with the representative target and a projectile is fired, it will hit the real target 190.

Optionally, once the real target 190 is selected, the processor identifies the target according to its shape and other characteristics, such as location, and tracks any change of location of the target automatically until another target is selected by the user.

When the representative target 230 coincides with the aiming indicator, e.g. crosshair 210, or is within a predefined error window, the barrel 105 is positioned to launch the projectile 120 so that it will follow the required trajectory 250 and hit the target 190. An error window may be calculated based on the distance of the real target, environment conditions such as wind, humidity, barometric pressure, projectile type, projectile ammunition dispersion and the like. Based on user selection and preference, which may he pre-defined to the ballistic software 185 or sight 110, the error window may determine that the firing of the projectile would hit real target. 190 even if the hit would be in close proximity to the target, for example, within 1 to 2 meters from the target. Such preference may be especially useful in relation to sonic targets, for example, a group of infantry soldiers, since the grenade projectile hitting the vicinity of such a target may still be effective in neutralizing the target or part thereof The error window can be preset in the sight 110 or the grenade launcher 100 and considered by ballistic software 185 when providing a ballistic solution. Optionally, an error window may be shown to the user of the grenade launcher 100 through showing of boundaries surrounding representative target 230. Optionally, the user of the grenade launcher 100 is provided with the option to fire the projectile when the grenade launcher is aimed to hit at the error window of the representative target 230, for example, through allowing a double-click on activation switch 150, or specific trigger indication or through other indications.

In an embodiment of the disclosure, to enable firing, the user moves the safety lever to a "fire enabled" position prior to firing. Alternatively or additionally, FCS 140 prevents release of projectile 120 until the user electronically authorizes that projectile 120 may he released.

The display 180 may be a digital display, an optical display or a combination of both, for example enabling the user to optically view through a transparent display and also view objects that are digitally injected onto the display to he viewed by the user. In some embodiments, display 180 may be a screen.

In an embodiment of the disclosure, movement by the user of the grenade launcher 100 is taken into account when calculating the trajectory to hit the real target 190 and the location in the sight 110 where the representative target 230 is displayed. For example, when the grenade launcher 100 is placed on a moving platform, e.g. an armored vehicle, and the armored vehicle is moving towards the real target 190, the representative target 230 is continuously displaced so to account for the changing trajectory.

In an embodiment of the disclosure, when the representative target 230 coincides with the aiming indicator, e.g., crosshair 210 the projectile is automatically launched if the safety lever is set to allow the launch (460). Optionally, grenade launcher 100 may also require that the trigger 125 also he engaged to automatically launch a projectile 120. Alternatively, the user only needs to press activation button 150 or pull the mechanical trigger 125 to launch (460) the projectile 120.

It should be noted that the sight 110 and the aiming indicator, e.g. crosshair 210, are typically calibrated relative to the grenade launcher 100 before being used to implement the methods described in this disclosure. In some embodiments of the disclosure, the sight 110 may support multiple modes of operation, for example:

a. a grenade launcher mode in which the aiming indicator is calibrated for launching heavy projectiles (e.g. 40 mm);
b. a bullet mode in which the aiming indicator is calibrated for shooting standard bullets (e.g. 5.56 mm);
c. a range identification mode, in which the aiming indicator is calibrated to measures the distance to the target.

Optionally, in each mode the aiming point is adjusted for use in the selected mode. In some embodiments of the disclosure, the sight identifies the mode automatically or the mode is selected manually.

Figure 5A:
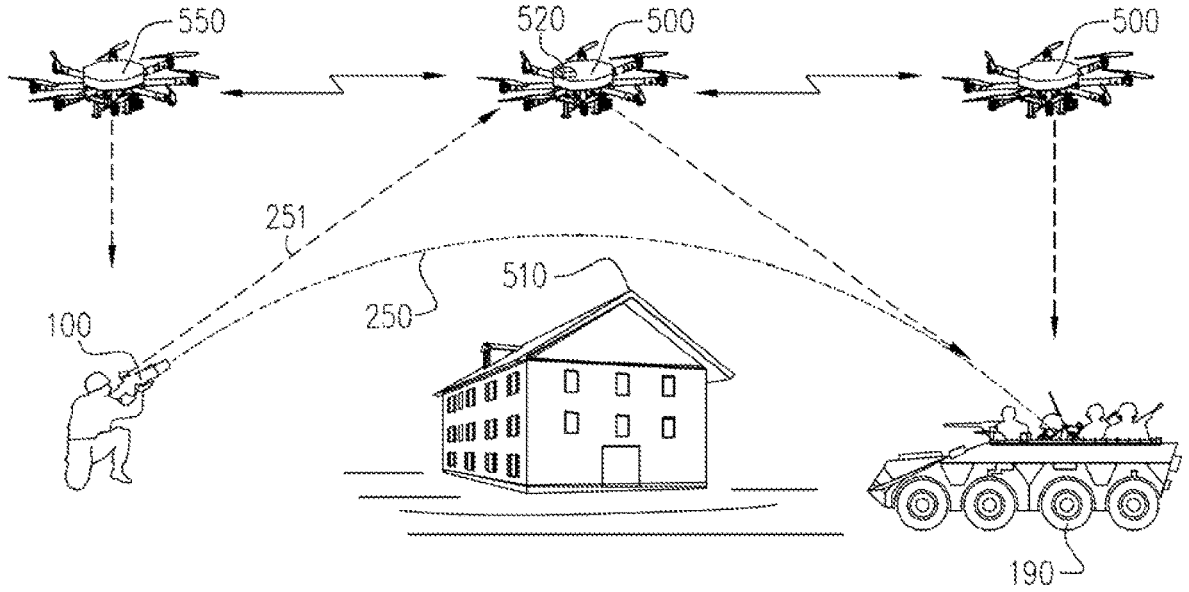
FIG. 5A is a schematic illustration of a grenade launcher launching a projectile at a target with an external aid that serves as a representative target, according to an embodiment of the disclosure.
Figure 5B:
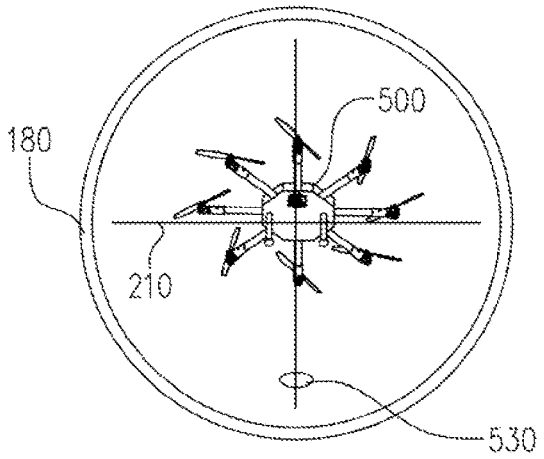
FIG. 5B is a schematic illustration of a display of a sight of a grenade launcher with an external aid that serves as a representative target, according to an embodiment of the disclosure.
Figure 6:
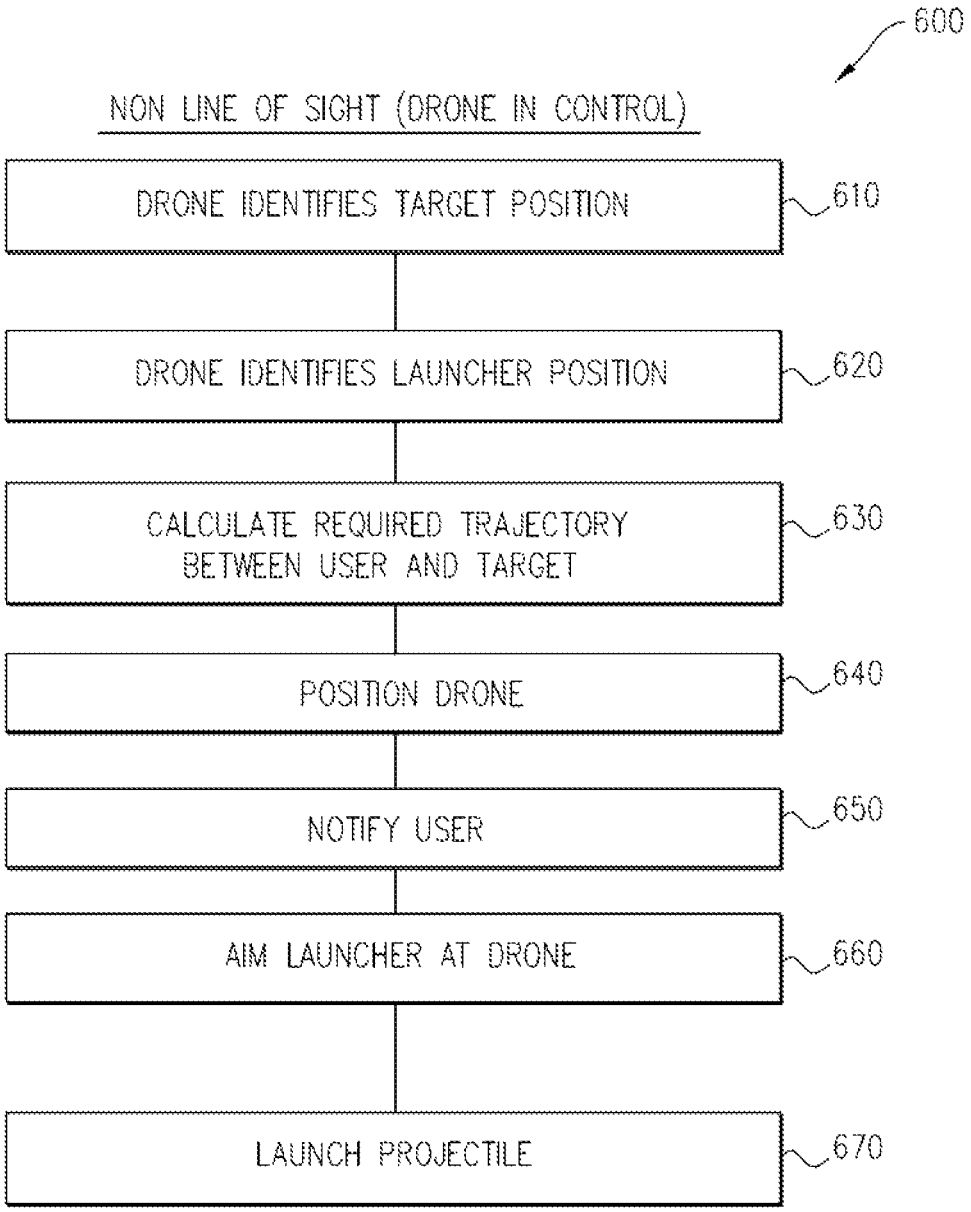
FIG. 6 is a flow diagram of a method of aiming a grenade launcher under control of an external aid that serves as a representative target, according to an embodiment of the disclosure.

FIG. 5A is a schematic illustration of grenade launcher 100 launching projectile 120 at target 190 with external aid that serves as a representative target, according to an embodiment of the disclosure. FIG. 5B is a schematic illustration of display 180 of sight 110 of grenade launcher 100 using external aid that serves as a representative target, according to an embodiment of the disclosure; and FIG. 6 is a flow diagram of a method (600) of launching a projectile using a grenade launcher, such as through aiming grenade launcher 100 under control of a drone 500, according to embodiments of the disclosure. A drone may he any unmanned aerial vehicle that is typically flown by remote control or autonomously without the intervention of human control.

In an embodiment of the disclosure, the grenade launcher 100 may be used to fire at a real target 190 that is not in the field of view of the user, for example, the real target 190 may be behind a barrier 510 blocking the user's view. Optionally, one or more drones 500 (or 550) are launched to identify the position of the real target 190 (610) (e.g., by GPS coordinates) and optionally also identify the position of the grenade launcher 100 (620). Alternatively, the grenade launcher 100 may identify its own position. Optionally, the one or more drones 500 (or 550) are in direct sight of the real target 190.

In some embodiments of the disclosure, a single drone 550 is used and serves as a main drone 550. In such embodiment, the drones 500, 550 can be a part of an unmanned aircraft system (UAS) that can fly autonomously while maintaining communication between the members of the UAS and optionally with user of the UAS on the ground, such as the grenade launcher. Optionally, the drone 550 identifies the grenade launcher 100 and the target 190, for example, with an imaging device (e.g. camera or video camera) installed on the drone 550 or the drone is programmed to identify specific targets 190 and/or grenade launchers 100. Optionally, the grenade launcher 100 sends to the drone 550 its location through communication interface 170, e.g. software and hardware. Including an antenna allowing RF communication. Once the grenade launcher 100 and target 190 are identified, the drone 550 calculates (630) a required trajectory 250 for the projectile 120 to hit the real target 190. The drone 550 then positions itself (640) between the grenade launcher 100 and the real target 190 to serve as the representative target 230 to which the user aims the sight 110, When the drone 550 is in position (640), the drone 550 notifies (650) the user, for example, by communicating with sight 110 and sounding an audio signal to the user or by turning on an indicator 530 (e.g. a light signal on the drone or an image on display 180).

In an embodiment of the disclosure, once the drone 550 is in position (in the line of sight 251 of the user) the user aims (660) the grenade launcher 100 at the drone 550, for example, by positioning an aiming indicator, e.g. a crosshair 210 to coincide with the drone 550 in sight 110, Display 180 may be transparent and enable the user to see through display 180 while adding crosshair 210, or display 180 may be configured to repeat what is seen in front of sight 110 while adding crosshair 210. Optionally, when the crosshair 210 coincides with the drone 550, the projectile 120 is automatically launched (670) or the user may release the projectile 120 manually to hit the target.

Optionally, depending on the distance of the drone 550 from the grenade launcher 100, a specific dot or other indication (not shown) is displayed so as to allow for more precise aiming by the user and higher chances of hitting the real target 190 when aiming at drone 550. Optionally, the specific dot is shown on the drone 550 itself, e.g. a red dot, IR beam, a cross painted on the drone, drone 550 to turn on a light with a specific wavelength to help being identified when viewed in the sight 110.

In some embodiments of the disclosure, more than one drone 550 is used. For example, one drone 550 may serve as the main drone to control the other drones 500. Optionally, one drone 500/550 is used to identify the real target 190, another drone 500/550 may identify the grenade launcher 100 and yet another drone 500/550 may serve as the representative target 230. Alternatively, one drone 500/550 may perform more than one action. Optionally, the drones 500/550 include various drone elements 520 to perform the required tasks. For example, the drone elements 520 may include cameras, sensors, a GPS, a Laser Range Finder (LRF), a self-navigation system, a target identification and tracking system, a target and user location calculation computer, communication transceivers, and controllers to locate and identify the grenade launcher 100 and real target 190, calculate trajectories, communicate with the grenade launcher 100 and/or other drones 500/550 and position one of the drones 500/550 to serve as the representative target 230.

In an embodiment of the disclosure, the drone system can operate even with a simple and standard Grenade Launcher sight because all the calculations are done by the drone 500/550 or drones. Optionally, drone 500/550 includes any unmanned aircraft, any type of human controlled flying object or any spotter/observer that can perform the tasks of drones 500/550 as described above.

In an embodiment of the disclosure, the drone 500/550 serving as the representative target 230 may be marked differently than the other drones 500/550 for example, have a different color, stripes, special lights, radiate a special RF signal or other markings.

Figure 7A:
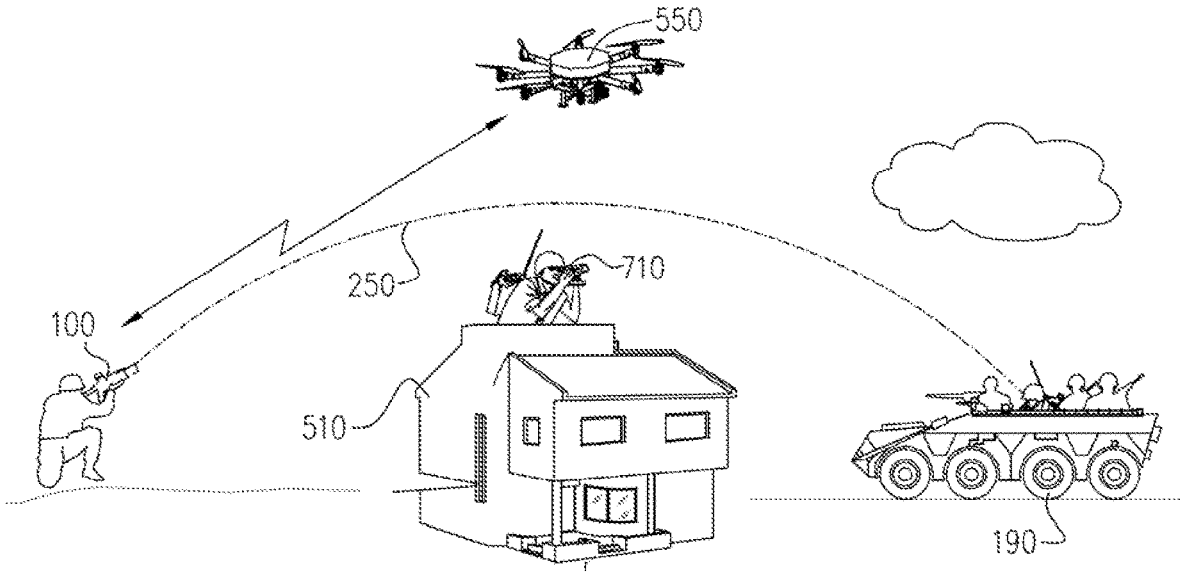
FIG. 7A is a schematic illustration of a grenade launcher launching a projectile at a non-line of sight target with external aid, according to an embodiment of the disclosure.
Figure 7B:
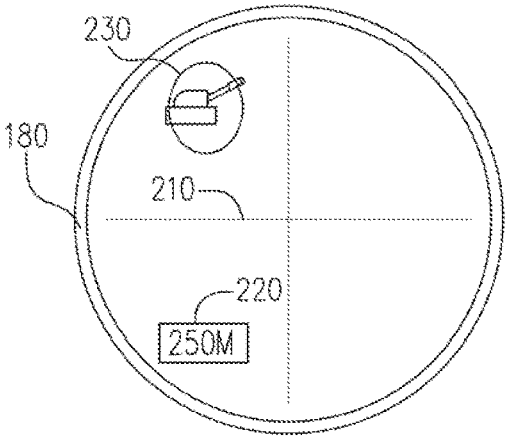
FIG. 7B is a schematic illustration of a display of a sight of a grenade launcher using external aid after receiving, the location of the target and calculating a representative target position, according to an embodiment of the disclosure.
Figure 7C:
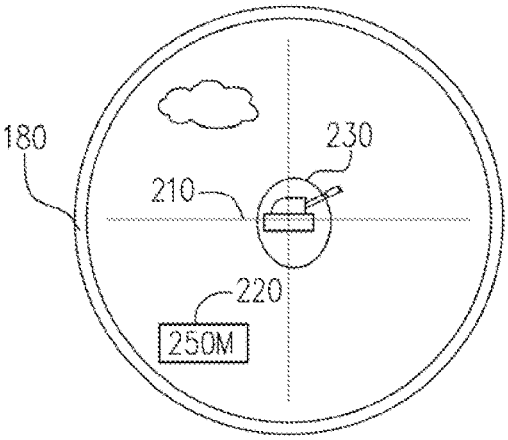
FIG. 7C is a schematic illustration of a display of a sight of a grenade launcher using external aid after aiming at a representative target, according to an embodiment of the disclosure.
Figure 8:
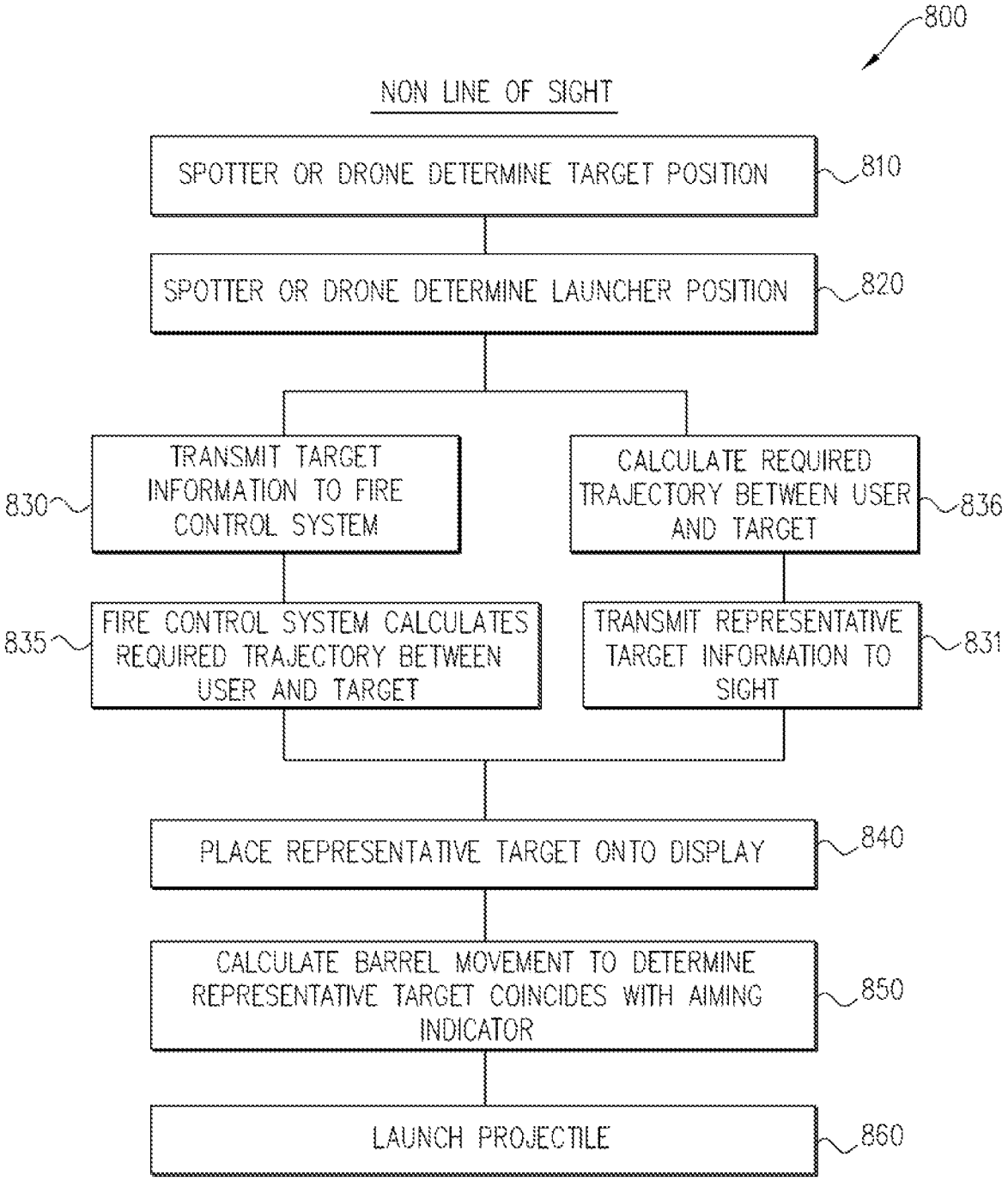
FIG. 8 is a flow diagram of a method of aiming a grenade launcher, according to an embodiment of the disclosure.

In an embodiment of the disclosure, at night the drones 500/550 may be instructed to turn on a light with a specific wavelength to help being identified by sight 110. Likewise, the drone camera may use night vision means to enable identification of the target 190 and the grenade launcher 100 in the dark, In an embodiment of the disclosure, the drone 500/550 can track a moving target or/and a moving user and continuously reposition the representative target drone 500/550 to match the new positions, so the projectile will hit the real target when fired by the user. Optionally, the calculation takes into account the movement of the target during the projectile time of flight. FIG. 7A is a schematic illustration of a grenade launcher 100 launching a projectile 120 at a target 190 with external aid, according to an embodiment of the disclosure. FIG. 7B is a schematic illustration of a display of a sight 110 of a grenade launcher 100 using external aid after receiving the location of the target 190, according to an embodiment of the disclosure. FIG. 7C is a schematic illustration of a display of a sight 110 of a grenade launcher 100 using external aid after aiming at the representative target 230, according to an embodiment of the disclosure. FIG. 8 is a flow diagram of a method 800 of aiming a grenade launcher 100, according to an embodiment of the disclosure.

In an embodiment of the disclosure, the user fires the projectile 120 at a real target 190 that is sighted by a drone 550 or a spotter 710, since the real target 190 may be blocked by a barrier 510 or other obstacles and not appear in the field of view of the user. Optionally, the spotter 710 or drone 550 may determine (810) the coordinates, (e.g. position of the real target 190 and optionally also determine (820) coordinates of the grenade launcher 100. Alternatively, the grenade launcher 100 may determine its own coordinates.

In an embodiment of the disclosure, the spotter 710 or drone 550 calculates (836) the required trajectory 250 for the grenade launcher 100 at its current position to hit the target 190. The drone 550 or spotter 710 then transmit (831) information of the required trajectory 250 to the sight 110. Alternatively, the spotter 710 or drone 550 may transmit (830) the coordinates of the target to the FCS 140 and the FCS 140 may calculate (835) the required trajectory 250 and show the representative target 230 on display 180 to enable accurately hitting the real target 190.

In an embodiment of the disclosure, a representative target 230 is placed (840) on the display 180 of the sight 110 to direct the user to aim at the target. The representative target 230 may be in the form of a real image of the actual target (e.g. acquired by the spotter 710 or drone 550) or a virtual image or icon of a target.

The user then adjusts (850) barrel 105 of the grenade launcher 100 to position the aiming indicator (e.g. crosshair 210) over the representative target 230. When the representative target 230 coincides with the aiming indicator, the user launches (860) the projectile 120 or the sight 110 provides an electronic signal to automatically launch the projectile 120.

In some embodiments of the disclosure, when identifying the target 190, with the sight 110, drone 550 or spotter 710, the target 190 is tracked for a few seconds to determine if the target is moving. Optionally, in the above embodiments when calculating the required trajectory 250, the movement of the target 190 and time that the target 190 was sampled is taken into account to predict the location of the target 1190 when the projectile 120 will hit it, even though the movement is not tracked in real-time. In this case, it is predicted that in the few seconds that it will take to aim and shoot, the real target will continue moving at a constant speed and in the same direction. Another and more accurate method is to keep track of the representative target by the drone 550 or spotter 710 and continue transmitting the real time target location to the grenade launcher 100 so that the FCS 1140 will continue to adjust the representative target 230 on the display :180 based on the actual motion of the target 190, until the user or the FCS 140 shoot the projectile 120 at the target 190.

In some embodiments of the disclosure, the FCS 140 takes into account the predicted movement of the real target within the time it takes the projectile to hit the real target after firing the grenade launcher.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to he within the scope of some embodiments of the disclosure.

It will be appreciated by persons skilled in the art that the present invention is not limited to what has been particularly shown and described hereinabove. Rather the scope of the present invention is defined only by the claims, which follow.

We claim:

1. A grenade launcher, comprising:

a barrel for launching a projectile at a real target;

a sight coupled to the barrel, the sight comprising a display that displays an aiming indicator, the display is also configured to display a representative target representing an indication for aiming the barrel so that the projectile will hit the real target;

a sensor configured to track motion of the barrel and responsive to the motion, move the representative target on the display of the sight;

wherein the grenade launcher is configured so that when the display of the representative target coincides with the aiming indicator, the grenade launcher is aimed to launch the projectile to hit the real target.

2. The grenade launcher of claim 1, wherein the representative target is displayed on the display responsive to calculating a trajectory to hit the real target after the real target was selected.

3. The grenade launcher of claim 1, wherein the representative target is displayed on the display responsive to information provided by a drone or a spotter that identified the real target.

4. The grenade launcher of claim 1, wherein the representative target is displayed on the display by aiming the sight at a drone in direct sight with the real target and positioned to serve as the representative target.

5. The grenade launcher of claim 1, wherein position of the representative target is calculated by a fire control system attached to the grenade launcher or in the sight.

6. The grenade launcher of claim 5, wherein the calculation by the fire control system considers motion of the real target and moves the representative target on the display accordingly.

7. The grenade launcher of claim 1, wherein position of the representative target is calculated by an external device and communicated to the sight.

8. The grenade launcher of claim 7, Wherein the position of the representa ve target is updated in real time responsive to motion of the real target and the grenade launcher.

9. The grenade launcher of claim 1, wherein the grenade launcher includes an electrical or mechanical trigger to launch the projectile using an electronic fire control system.

10. The grenade launcher of claim 1, wherein the projectile is automatically launched when the display of the representative target coincides with the aiming indicator within a predefined error window.

11. The grenade launcher of claim 1, wherein the representative target is represented by an image of the real target.

12. The grenade launcher of claim 1, wherein the representative target is positioned to take into consideration motion of the real target.

13. A method of aiming a grenade launcher, the grenade launcher having a barrel, a sensor and a sight with a display, the method comprising:

selecting a real target;

determining a distance to the real target;

calculating a trajectory to hit the real target;

displaying a representative target representing an indication for aiming the barrel so that the projectile will hit the real target;

displaying an aiming indicator;

tracking motion of the barrel by the sensor and moving the representative target on the display responsive to the motion of the barrel;

determining the grenade launcher is aimed to launch the projectile to hit the real target when the representative target coincides with the aiming indicator.

14. The method of claim 13, wherein the step of displaying the representative target is based on the calculated trajectory to hit the real target.

15. The method of claim 13, wherein the step of displaying the representative target is responsive to information provided by a drone or a spotter.

16. The method of claim 13, wherein step of displaying the representative target comprises displaying a drone, the drone in direct sight with the real target and is positioned to serve as the representative target.

17. The method of claim 13, wherein the step of calculating the trajectory is performed by a fire control system attached to the grenade launcher or in the sight.

18. The method of claim 13, wherein the step of calculating the trajectory is calculated by an external device and communicated to the sight.

19. A method of aiming a grenade launcher at a real target, comprising:

determining a distance to the real target;

calculating a trajectory to hit the real target;

displaying a representative target representing the real target through a weapon sight that is coupled to a barrel of the grenade launcher; and aiming the barrel toward the representative target thereby aiming the grenade launcher to launch a projectile to hit the real target.

20. A drone, comprising:

a controller that calculates a trajectory of a projectile from a grenade launcher position to hit a real target; and wherein the controller is configured to position the drone above the trajectory to serve as a representative target, so that when the grenade launcher is aimed toward the drone and fires the projectile it will hit the real target.

* * * * *